US005082070A

United States Patent [19]

Obermeier et al.

[11] Patent Number: 5,082,070

[45] Date of Patent: Jan. 21, 1992

[54] HOLLOW DRILL BIT

[75] Inventors: Josef Obermeier, Peiting; Rolf Spangenberg, Gauting, both of Fed. Rep. of Germany; Theodor Linke, Schaan, Liechtenstein

[73] Assignee: Hilti Aktiengesellschaft, Fürstentum, Liechtenstein

[21] Appl. No.: 612,614

[22] Filed: Nov. 13, 1990

[30] Foreign Application Priority Data

Nov. 13, 1989 [DE] Fed. Rep. of Germany ..... 3937697

[51] Int. Cl.[5] ..... E21B 17/04

[52] U.S. Cl. ..... 175/403; 175/411; 285/286; 285/287

[58] Field of Search ..... 175/403, 411, 320, 327; 285/286, 287, 330

[56] References Cited

U.S. PATENT DOCUMENTS

| | | | |
|---|---|---|---|
| 649,488 | 5/1900 | Schrader | 175/403 |
| 2,034,808 | 3/1936 | Graham | 285/286 |
| 2,094,495 | 9/1937 | Robinson et al. | 285/287 |
| 2,206,166 | 7/1940 | Dunn | 285/286 |
| 2,460,667 | 2/1949 | Wurzburger | 285/287 |
| 2,665,886 | 1/1954 | Ellis | 175/411 |
| 2,750,156 | 6/1956 | Coates | 175/411 |
| 4,182,950 | 1/1980 | Boros | 285/286 |
| 4,657,441 | 4/1987 | Horvath | 175/403 |

FOREIGN PATENT DOCUMENTS

| | | | |
|---|---|---|---|
| 289780 | 8/1976 | U.S.S.R. | 285/287 |

*Primary Examiner*—William P. Neuder
*Attorney, Agent, or Firm*—Toren, McGeady & Associates

[57] ABSTRACT

A hollow drill (1) is made up of a tubular carrier part (2), a cutter part (3) and an intermediate part (4) extending between the carrier part (2) and cutter part (3). The intermediate part (4) is rigidly fixed to the cutter part (3). The carrier part (2) and the intermediate part (4) have axially extending extensions (11, 12) which telescope one into the other with solder (8) located between and removably connecting the extensions (11, 12) together.

6 Claims, 1 Drawing Sheet

HOLLOW DRILL BIT

BACKGROUND OF THE INVENTION

The present invention is directed to a hollow drill bit formed by a tubular carrier support part, an annular cutter part and an annular intermediate part extending between the cutter part and the carrier part. The intermediate part and the cutter part are secured together. The intermediate part and the carrier part are soldered together along facing surfaces thereof.

For drilling in hard materials, such as concrete, hollow drill bits with diamond tipped cutting parts are used if it is intended to drill dimensionally accurate holes in a material possibly containing reinforcing steel without causing any noise or jarring.

Conventional hollow drill bits have annular or segment-shaped cutting parts and are connected with a tubular carrier part by sintering for forming a durable and solid connection. When the cutting part, because of wear, reaches the end of its useful life, due to the non-detachable sintered connection the entire drill bit must be scrapped at a high cost.

Therefore, for lowering costs, it is a requirement for such drill bits that the worn cutter parts be detachable from the carrier part so that the worn parts can be replaced by new cutter parts. In this regard, a hollow drill bit is disclosed in CH PS 603 329 having a cutter part connected to a tubular carrier part by an intermediate part or ring. The annular intermediate part is soldered to the carrier part and can be removed along with the cutter part after the soldered connection has been broken and then it can be replaced by another intermediate part with a new cutter part which must be soldered to the carrier part.

Though the connection between the intermediate part and the carrier part is easily detachable because of the soldered connection, the replacement of the intermediate part equipped with a new cutter part requires considerable apparatus and appropriate specialized knowledge to achieve a functional connection and obtain the required true concentric rotation of the drill bit.

SUMMARY OF THE INVENTION

Therefore, the primary object of the present invention is to provide a hollow drill bit capable of being equipped with new cutter parts without requiring any special apparatus and without any specialized knowledge and, at the same time, assuring the proper functioning of the drill bit.

In accordance with the present invention, the adjacent end faces of the carrier part and the intermediate part are provided with annular extensions for connecting the two parts together with the extension of one part telescoped axially into the other part over a specific length.

Concentric alignment of the carrier part and intermediate part is assured by the axial overlap of the annular extensions, due to the telescopic interconnection of the extensions. The surfaces of the carrier part and intermediate part facing one another and extending along the extensions assure along with the end faces of both parts facing one another, a large area soldered connection affording high holding or retaining values.

The soldering operation is effected after interfitting the carrier part and intermediate part with the cutter part secured to it, so that the extension of one extends telescopically into the extension of the other. The axially extending region of the carrier part and the intermediate part equipped with the extensions is heated to soldering temperature, for example, by an annular burner. Next, a soldering rod is applied from the outside to the area between the free end of the radially outer extension and the part having the radially inner extension with the soldering rod being guided in the circumferential direction about the junction region. The melting solder is drawn by capillary action between the facing surfaces of the extensions. Preferably, the facing surfaces of the extensions to be soldered together are provided with a flux agent before the extensions are telescoped one into the other. A sintered connection between the cutting part and the intermediate part is not impaired or affected by the soldering process.

In a preferred arrangement, the extensions have a length corresponding to a range of 1.5 to 4 times the wall thickness of the carrier part. Such a length assures a tilt-free axially parallel alignment of the carrier part and the intermediate part.

In accordance with the invention, the radially inner extension of one part has a greater length than the radially outer extension of the other part. Due to the greater length of the radially inner extension, when the two parts are telescoped one into the other, the radially inner extension contacts the end face of the part having the shorter axial extension, whereby an axial spacing for receiving solder is formed between the shorter extension and the end face of the part having the longer extension. As a result, the annularly shaped end faces of the longer extension and the other part in contact with one another afford a sealing effect during the soldering operation, so that free access of solder towards the inside of the carrier part and the intermediate part is eliminated. To possibly enable an escape of flux means, at least one of the contacting end faces can be provided with knurling defining passageways suitable for such escape. Suitable dimensioning of the space between the end faces of the shorter extension and of the face of the other part is achieved preferably if the longer extension has a length in the range of 1.0 to 1.1 times the length of the shorter extension.

In a preferred arrangement a radial spacing in the range of 0.02 to 0.15 times the wall thickness of the carrier part exists between the facing surfaces of the extensions. Such radial spacing permits, on one hand, a smooth sliding of the extensions inside one another and assures, on the other hand, a sufficient mutual concentric guidance of the extensions. The radial spacing is in the form of a circumferential annular gap between the facing surfaces of the extensions. The annular gap promotes the uniform distribution of the solder between the extensions.

Preferably the extensions have the same wall thickness. This feature assures a uniform heating of the extensions for the soldering process providing a uniform connection of the solder with the surfaces of the carrier part and the intermediate part to be secured together.

The radially outer edges of the end surfaces of the extensions and the facing end surfaces of the two parts are advantageously chamfered. The chamfering on the radially outer surface creates a pocket for receiving the solder which flows during the soldering process from the pocket between the carrier part and the intermediate part. Accordingly, solder particles which possibly could impair the drilling operation do not extend beyond the axially extending surfaces of the carrier part and the intermediate part. The pocket on the outer surface additionally facilitates the soldering process by affording guidance of the soldering rod.

In a preferred arrangement, the radially inner extension is provided on the carrier part and the radially outer extension on the intermediate part. As a result, the radially outer extension is replaced along with the worn cutter part, since the radially outer extension is subject to greater wear than the radially inner extension. The continuous cylindrical external surface of the part trailing the cutter part is responsible for satisfactory guidance of the hollow drill bit in the borehole and remains in existence in the region between the carrier part and the intermediate part formed by the radially outer extension.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
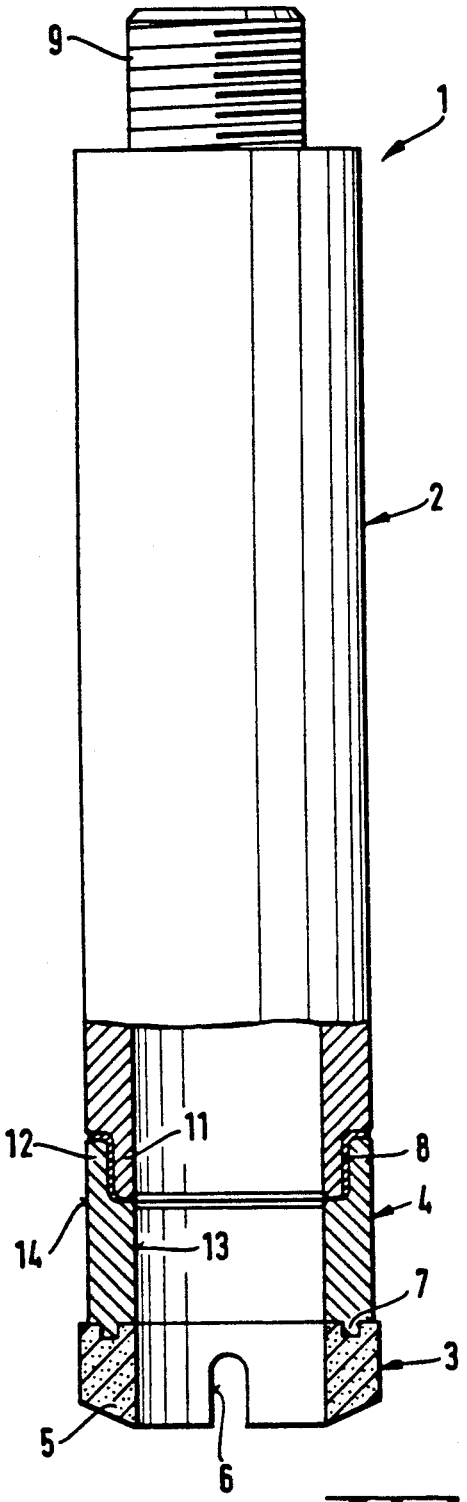
FIG. 1 is an elevational view, partly in section of a hollow drill bit embodying the present.
Figure 2:
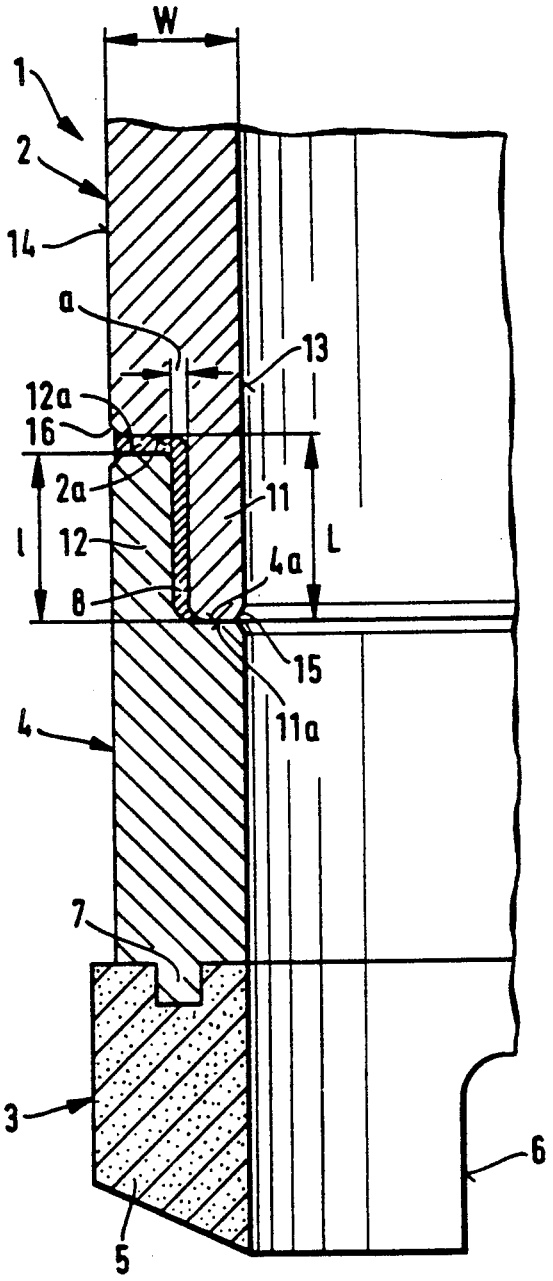
FIG. 2 is a sectional view of a portion of the hollow drill bit shown sectioned in FIG. 1 and illustrated on an enlarged scale.

In FIG. 1 a hollow drill bit 1 is displayed for its full axial length and comprises a tubular carrier part 2, a cutter part 3, and an intermediate part 4 extending between the cutter part and the carrier part. As viewed in FIG. 1 the drilling direction of the hollow drill bit 1 is in the downward direction. Accordingly, each of the parts has a leading end located below a trailing end relative to the drilling direction. Cutter part 3 containing diamond grains 5 is fabricated in a sintering process, is annular shaped and is sub-divided by slots 6 extending from the leading end toward the trailing end. The slots 6 are spaced apart in the circumferential direction of the drill bit. Cutter part 3 is rigidly connected to the intermediate part 4 in a sintering operation. An annular ring 7 secured to and projecting from the leading end of the intermediate part 4 engages into a corresponding recess in the trailing end of the cutter part 3 and assures the mutual concentric alignment of the two parts. The connection of the intermediate part 4 to the carrier part 2 is provided by solder 8. At the trailing end of the carrier part 2 there is a threaded stub 9 projecting axially from the carrier part, so that the drill bit can be clamped into a driving device.

The leading end of carrier part 2 and the trailing end of intermediate part 4 each has an axially extending extension 11, 12 which telescope one into the other for affording concentric alignment of the two parts. Extension 11 on carrier part 2 is located radially inwardly from the extension 12 o the intermediate part. The axial length L of the extension 11 is greater than the axial length 1 of the extension 12 on the intermediate part. The lengths L, 1 are in the range of 1.5 to 4 times the wall thickness W of the carrier part. The radial dimension of the extensions 11, 12 provide a radial spacing a in the form of a circumferentially extending annular gap between the axially extending facing surfaces of the extensions. Solder 8 flows through the annular gap provided by the spacing a, shown magnified in the drawing for purposes of clarity, and in practice is in the range of 0.02 to 0.15 times the wall thickness W. Further, due to the difference in the axial lengths of the extensions 11, 12 the end face 12*a* of extension 12 is spaced in the axial direction closely from the leading end face 2*a* of the carrier part. The end face 11*a* of the radially inner longer extension 11 contacts the end face 4*a* at the trailing end of the intermediate ring and prevents passage of solder 8 flowing due to capillary action from the radially outer side to the radially inner side of the carrier part 2 and the intermediate ring 4. Pockets 15, 16 are provided at the radially inner and radially outer surfaces 13, 14 of the drill bit in the region of the end faces 11*a*, 12*a* of the extensions 11, 12 and the end faces 2*a*, 4*a* of the parts 2, 4 for receiving any solder 8 which might possibly escape. The pockets 15, 16 are formed by chamfered transitions between the end faces 2*a*/12*a*, 4*a*/11*a* and the drill bit surfaces 13, 14.

To replace a possible worn unit formed of a cutter part 3 and an intermediate part 4, the solder can be thermally removed in a simple manner and after placing a new cutter part 3 and intermediate ring 4 on the carrier part 2 the solder can be introduced into the space between the carrier part and the intermediate part for securing these parts together.

While specific embodiments of the invention have been shown and described in detail to illustrate the application of the inventive principles, it will be understood that the invention may be embodied otherwise without departing from such principles.

We claim:

1. Hollow drill bit (1) comprises an axially extending tubular carrier part (2), and annular cutter part (3) spaced axially from said carrier part (2), and an annular intermediate part (4) extending between said carrier part (2) and cutter part (3), said cutter part (3) is fixed to said intermediate part (4), said drill bit (1) having a drilling direction and each of said carrier part (2), intermediate part (4) and cutter part (3) has a leading end and a trailing end relative to the drilling direction, said carrier part (2) has an axially extending annular first extension (11) at the leading end thereof and said intermediate part (4) has as axially extending annular second extension (12) at the trailing end thereof, one of said first and second extensions (11,12) is located radially inwardly of and fits telescopically into the other, said one of said first and second extensions (11,12) has an axial length L greater than the axial length 1 of the other, wherein the improvement comprises that said first extension (11) on said carrier part (2) is spaced radially from said second extension (12) on said intermediate part (4) by a dimension (a) in the range of 0.02 to 0.15 times the wall thickness (w) of said carrier part (2), and a soldered joint fixes the intermediate part (4) to the carrier part (2) with the soldered joint extending radially inwardly from an outside surface of said carrier part (2) and for the axial lengths of the first and second extensions (11, 12).

2. Hollow drill bit, as set forth in claim 1, wherein said extensions (11, 12) have axial lengths (L, l) in the range of 1.5 to 4 times the wall thickness of the carrier part (2).

3. Hollow drill bit, as set forth in claim 2, wherein said first extension (11) of said carrier part (2) is located radially inwardly of said second extension (12) of said intermediate part (4) and said radially inner first extension (11) has a greater length (L) than the length (1) of said extension (12) of said intermediate part (4).

4. Hollow drill bit, as set forth in claim 3, wherein the length (L) of said longer first extension (11) on said carrier part (2) is in the range 1.02 to 1.1 times the length (1) of said second extension (12) on said intermediate part (4).

5. 6. Hollow drill bit, as set forth in claim 1, wherein each of said extensions (11, 12) has the same radial wall thickness.

6. Hollow drill bit, as set forth in claim 5, wherein each of said cutter part (3) and said intermediate part (4) has a radially inner surface (13) and a radially outer surface (14) said carrier part (2) has a leading end face (2*a*) and said first extension (11) on said carrier part (2) has a leading end face (11*a*) and said intermediate part (4) has a trailing end face (4*a*) and said second extension (12) on said intermediate part (4) has a trailing end face (12*a*) and transitions between said radially outer surface (14) and said end face (2*a*) between said radially outer surface (14) and said end face (12*a*) between said radially inner surface (13) and said end face (11*a*) and between said radially inner surface (13) and said end face (4*a*) are chamfered.

* * * * *